United States Patent [19]

Matsumoto et al.

[11] Patent Number: 4,596,623

[45] Date of Patent: Jun. 24, 1986

[54] PRODUCTION OF A FILMED FORMWORK

[75] Inventors: Mitsuo Matsumoto, Suitashi; Kohei Deguchi, Ikomashi, both of Japan

[73] Assignee: Kobunshi Giken Kabushiki Kaisha, Osaka, Japan

[21] Appl. No.: 599,794

[22] Filed: Apr. 13, 1984

[30] Foreign Application Priority Data

May 2, 1983 [JP] Japan ..... 58-77821
Jan. 19, 1984 [JP] Japan ..... 59-7616

[51] Int. Cl.[4] ..... B05D 1/38; B05D 3/02; B05D 5/08; B05D 7/06

[52] U.S. Cl. ..... 156/283; 156/289; 427/133; 427/194; 427/195; 427/202; 427/408

[58] Field of Search ..... 156/283, 279, 289; 428/352, 537.1; 427/189, 194, 195, 203, 214, 359, 393, 397, 202, 398.3, 398.2, 408, 375, 133, 366; 249/115, 189; 264/338

[56] References Cited

U.S. PATENT DOCUMENTS

| | | | |
|---|---|---|---|
| 2,663,652 | 12/1953 | Railing | 427/195 |
| 3,348,995 | 10/1967 | Baker et al. | 156/283 X |
| 3,424,607 | 1/1969 | Coscia | 427/133 |
| 3,449,145 | 6/1969 | Bloom et al. | 427/195 |
| 3,497,375 | 2/1970 | Rundle | 427/408 X |
| 3,632,372 | 1/1972 | Heslop et al. | 427/195 X |
| 3,650,795 | 3/1972 | Willingham | 427/408 X |
| 4,371,568 | 2/1983 | Von Tell | 427/195 X |

*Primary Examiner*—Edward Kimlin
*Assistant Examiner*—Ramon R. Hoch
*Attorney, Agent, or Firm*—Barnes & Thornburg

[57] ABSTRACT

A method of filming the surface of a plywood used for formwork, the method comprising dispersing a first dose of an adhesive polyolefine resin powder on the surface of the plywood, heating the dispersed resin powder on the plywood, thereby enabling the resin powder to spread thereon in a molten state, dispersing a second dose of non-adhesive polyolefine resin powder, heating the second dose of resin powder on the film produced by the first dose of resin powder, flattening the resin layers on the plywood by passing same through press rollers, and finally cooling the flattened resin layer.

15 Claims, 3 Drawing Figures

PRODUCTION OF A FILMED FORMWORK

BACKGROUND OF THE INVENTION

The present invention relates to the production of plywood used for formwork or shuttering for receiving a cast concrete. More particularly, the present invention relates to the production of plywood used as a formwork, the plywood being filmed so as to increase its surface strength and removability from concrete.

In fabricating a formwork special attention must be paid to the fact that the formwork must support the weight of concrete, the men working thereon, and the load of mechanical ramming. In addition, the formwork must be readily removed as soon as the concrete has set. In order to withstand these severe external strain, the plywood constituting a formwork must be strong and readily removable from the concrete.

OBJECTS AND SUMMARY OF THE INVENTION

The present invention is to provide a method of filming the surface of the plywood used for formwork, thereby enhancing its durability and removability.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to one advantageous aspect of the present invention, a method comprises dispersing a first dose of an adhesive polyolefine resin powder on the surface of the plywood, heating the dispersed powder on the plywood, thereby enabling same to spread thereon in a molten state, dispersing a second dose of non-adhesive polyolefine resin powder, heating the second dose of powder on the film produced by the first dose of resin powder, flattening the resin layers of the first and second dose of resin powder by means of press rollers, and allowing the flattened resin layer to cool down.

DETAILED DESCRIPTION OF THE INVENTION

Figure 1:
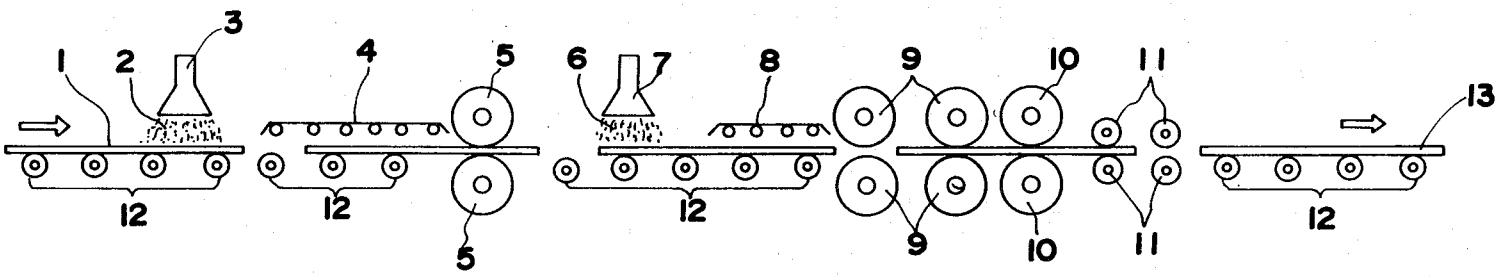
FIG. 1 is a diagrammatic view exemplifying the sequence of process.

Referring to FIG. 1, a plywood 1 is conveyed by a conveyor 12, in the course of which an adhesive polyolefine resin powder 2 is dispersed on the surface of the plywood 1 by means of a disperser 3. The amount of the powder is in the range of 10 to 20 g/m$^2$. The adhesive polyolefine resin powder is made by using, for example, CMP-HA-40 produced by Tonen Oil Chemistry Co., Ltd., which has an adhesive property achieved through chemical reaction of polyolefine resin. The grain-size of the powder is preferably in the range of 70 to 200 mesh. For the disperser 3 a device utilizing electrostatic force can be effectively employed.

The plywood 1 is futher advanced to pass under a heater 4, for example of infrared rays, where preheating is achieved. The plywood 1 reaches heating rollers 5, where the dispersed powder 2 is firmly bonded on the surface of the plywood. Thanks to the pressure by the heating rollers 5 the resin film on the surface of the plywood is flattened. For this purpose a linear pressure of 30 kg/cm or more is required.

The plywood 1 continues to advance to pass under a second disperser 7 designed to disperse a second dose of polyolefine resin powder 6, which is different from the first olefine resin powder in its non-adhesive nature. The second dose of resin powder is dispersed on the film formed by the first dose of olefine resin powder, thereby forming a dual-layer of polyolefine resin. The amount of the second dose depends on the desired strength of the product, but is normally in the range of 50 to 100 g/m$^2$. The non-adhesive polyolefine resin, as its name implies, has no adhesive property, but the base material is preferably the same as that for the first-mentioned adhesive polyolefine resin. The grain-size is in the range of 70 to 200 mesh, and it is preferred that its molecular weight is as large as possible.

The plywood 1 proceeds to a second set of preheating rollers 8, and then to heating press rollers 9, whereby a second film is formed on the first film. The second film is 50 to 100 microns thick. In order to heat the second dose of resin powder sufficiently, more than 2 sets of heating press rollers 9 are necessarily provided.

As the plywood is further advancing, the temperature at the surface of the film lowers and lowers, during which crystalization occurs. It is, however, necessary to re-press the film before the crystalization proceeds too far. The press rollers 9 have a temperature at which the olefine resin becomes soft. Accordingly, the film is compressed while the crystalization proceeds. This ensures that the molecules are arranged in one direction under the compression. Thus the film has strong intermolecular linkage. As a product the surface of the plywood has strong anti-shock property.

Each of the rollers 10 has a polished surface like a mirror, and the surface of the outermost film is made even and smooth, thereby securing the removability of the plywood from the concrete.

Finally, the plywood 1 passes through cooling rollers 11, whereby the film is hardened at about 70° C. or below.

It is preferred that the temperature of the press rollers 11 is adjusted in the range of 90° to 100° C. it is also preferred that the press rollers 10 are located adjacent to the heating rollers 9, so as to ensure that the compression by the press rollers 10 is performed before the crystalization proceeds too far. However, there is a limitation to the shortening of the time for which the heated plywood proceeds the press rollers 11 during which the heat is allowed to release. The limitation is due to the limited relationship between the sizes of the heating and the press rollers and the speeds of rotation. The maximum period of time is about 3 seconds. If the plywood is transported at an increased speed, the heating time is accordingly shortened, thereby resulting in the insufficient heating of the resin. As a remedy an auxiliary heating roller **9*s* is provided adjacent to the press rollers 10, thereby avoiding a possible cooling of the plywood. The auxiliary heating roller 9*s*** can add a further pressure on the plywood while it is passing therethrough. Its diameter can be 100 mm or so.

Reference will be made to the method of adding fluorine resin to the non-adhesive polyolefine resin so as to enhance the removability of the formwork from concrete:

For the fluorine resin 0.5 to 5% of ethylene tetrafluoride is added, due to the addition of which the plywood loses its viscosity in the course of transferring to the second heating rollers 9, thereby allowing its surface to become even and smooth. Otherwise, the surface thereof would be likely to become uneven because of its surfacial tenaciousness. The reduced viscosity helps in smoothing the surface of the plywood by the press rollers.

Figure 3:
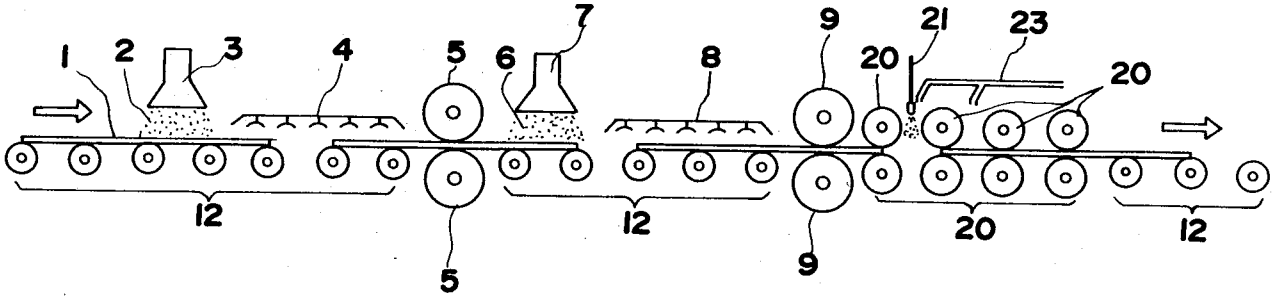
FIG. 3 is a diagrammatic view exemplifying the sequence of process in a modified version.

For a cooling device, the apparatus can be provided with a water sprinkler 21 and air nozzles 23 as shown in FIG. 3. The reference numeral 20 designate cooling rollers, each of which has a surfacial temperature ranging from 10° to 25° C. The air nozzles are intended to keep the surfacial temperture of the cooling rollers 20 at a desired temperature in this range. For this purpose, the temperature of the air through the nozzles 23 is adjusted so as to be below the temperature on the cooling rollers 20. In this way the resin films on the plywood are rapidly cooled, thereby ensuring that fine crystallization occurs, which leads to the smooth surfaces of the plywood. As described above, the smooth surface of the plywood secures durability and removability from concrete.

For better understanding, examples will be described:

EXAMPLE 1

The apparatus shown in FIG. 1 was employed, and the first heating rollers 5 were heated to 220° C., the second heating rollers 9 to 190° C., and the press rollers 10 to 90° C. The cooling rollers 11 were cooled to the temperature of water. The infrared heater 4 was 4 m long, the second heater 8 was 2 m long, and electrostatic spray guns were employed as the first and the second dispersers 3 and 7. The conveying speed was 10 m/min. For the adhesive polyolefine resin the product "CMP/HA-40" by Tonen Oil Chemistry Co., Ltd., in a powdery mixture of 70 to 150 mesh, was used. For the non-adhesive polyolefine resin "Hizex-8200CP" produced by the same manufacturer was used. The used plywood was 12 mm thick with five plies.

The adhesive polyolefine resin powder was equally dispersed on the plywood at a rate of 20 g/m$^2$, and was caused to pass under the heater 4 and through the heating rollers 5. Then the non-adhesive polyolefine resin powder was dispersed on the adhesive layer at a rate of 80 g/m$^2$. The plywood was heated by the second heater 8 and the second heating rollers 9, and pressed by the press rollers 10. Finally the plywood was colled by the cooling rollers 11, and its surface was polished. The distance between the last heating rollers 9 and the press rollers 10 was 450 mm, and the heat releasing period of time was 2.7 sec. The anti-shock property, durability and removability from concrete were considerably improved.

EXAMPLE 2

As the non-adhesive polyolefine resin powder the "Hizex 8200BP" produced by the above-mentioned manufacturer was used with the addition of 20% of fluorine resin "L-5" produced by Daikin Kogyo Co., Ltd. After they were well mixed, the mixture was overlaid in the above-mentioned manner. In addition to the improved anti-shock property and durability, the surfacial smoothness was considerably improved.

EXAMPLE 3

Figure 2:
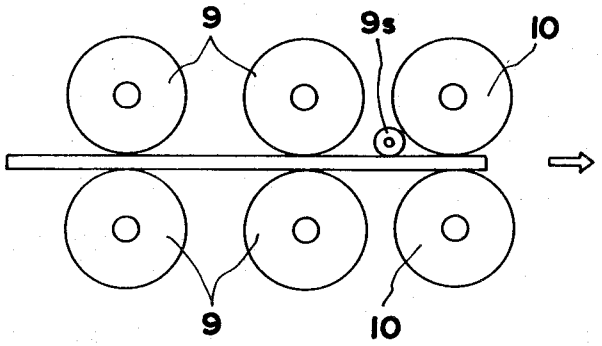
FIG. 2 shows an arrangement of heating rollers, press rollers and auxiliary rollers on an enlarged scale.

The apparatus shown in FIG. 2 was employed. The first heating rollers 5 were heated to 220° C., the second heating rollers 9 to 190° C., and the auxiliary heating rollers **9*s* to 90° C. The cooling rollers 11 were cooled to the water temperature. The infrared heater 4 was 2 m long, and the second heater 8 was 2 m long. For the dispersers 3 and 7 electrostatic spray guns were used. The conveying speed was 6 m/min. The distance between the last heating rollers 9 and the press rollers 10 was 520 mm, and that between the auxiliary heating rollers 9*s* and the press rollers 10 was 200 mm. The diameter of the auxiliary heating roller 9*s* was 8 mm, and that of the press roller 10 was 300 mm. The same plywood and resin as those used in the example 1 were used. The period of time allowing heat to release was 2 seconds. In spite of the relatively slow speed of the conveyor 12 no crystalization occurred by virtue of the employment of the auxiliary heating rollers 9*s***. The anti-shock property, durability and removability from concrete were improved.

EXAMPLE 4

The apparatus shown in FIG. 3 was employed. The heating rollers 5 and 9 are heated to 220° C. A cooling water having a temperature of 15° C. was circulated throughout each of the cooling rollers 20, and infrared heaters were employed for the heaters 4 and 8, each being 4 m long. Electrostatic spray guns were used for the powder dispensers 3 and 7. A cold air was blown through the nozzle 23. The conveying speed was 10 m/min. For the adhesive resin powder the "Admer NS-100" produced by Mitusi Oil Chemistry Co., Ltd., in a form of powder of 50 to 150 mesh, was used. For the polyolefine resin powder, the "Hizex-8200CP" produced by the same manufacturer was used in grain-size of 50 to 200 mesh. The used plywood was 12 mm thick with five lies, which was available in the market.

The adhesive resin was equally dispersed on the plywood at a rate of 20 g/m$^2$, and was passed under the heater 4 and through the heating rollers 5. Then the non-adhesive polyolefine resin powder was dispersed on the adhesive resin layer at a rate of 120 g/m$^2$, and was passed under the second heater 8 and through the second heating rollers 9. At the cooling section the plywood in conveyance was subjected to cooling air of 5° C. by means of the cooling nozzles 23. The water sprinkler 21 was not used. The distance between the heating roller 9 and the first-situated cooling rollers 20 was 400 mm, over which the plywood was conveyed in 2.4 seconds. The durability and removability from concrete were improved.

EXAMPLE 5

The apparatus shown in FIG. 3 was employed. The same method was applied as that used in the example 4, from the disperser 3 up to the second heating rollers 9, but this example was different from the example 4 in that the water sprinkler 21 was employed, through which a cooling water was sprayed on the resin film covering the plywood. In the course of passing through the cooling rollers 20 water drops on the resin film vaporized. As a result, the surface of the plywood had a temperature about 7° C. lower than that achieved in the example 4. The crystalization was found minute. The durability and removability from concrete were remarkably improved.

EXAMPLE 6

The apparatus shown in FIG. 3 was employed. The same method was applied as that used in the example 4, from the disperser 3 up to the second heating rollers 9. This example was different from the example 5 in that both the water sprinkler 21 and the cooling nozzles 23 were used. In the course of passing through the cooling rollers 20 water drops on the resin film vaporized. The temperature on the surface of the plywood was about 3° C. lower than that achieved in the example 5.

What is claimed is:

1. A method of filming the surface of a plywood used for formwork, the method comprising dispersing a first dose of an adhesive polyolefine resin powder on the surface of the plywood, heating the dispersed resin powder on the plywood, thereby enabling the resin powder to spread thereon in a molten state so as to form a first layer, dispersing a second dose of non-adhesive polyolefine resin powder, heating the second dose of resin powder on the layer produced by the first dose of resin powder so as to form a second layer, flattening the resin layers on the plywood by passing through press rollers, and finally cooling the flattened resin layers.

2. A method as defined in claim 1, wherein the non-adhesive polyolefine resin powder contains fluorine resin in a powdery form.

3. A method as defined in claim 1, wherein the cooling is performed with the use of air, thereby enabling the resin layer on the plywood to cool down rapidly.

4. A method according to claim 1, wherein the first resin layer is flattened prior to dispersing the second dose of resin powder.

5. A method according to claim 1, wherein the amount of adhesive polyolefine resin powder dispersed on the plywood surface is between 10 grams per square meter and 20 grams per square meter.

6. A method according to claim 1, wherein the grain size of the adhesive polyolefine resin powder employed is between 70 mesh and 200 mesh.

7. A method according to claim 1, wherein the adhesive polyolefine resin powder is dispersed utilizing an electrostatic disperser.

8. A method according to claim 1, wherein the adhesive polyolefine resin powder is heated by an infrared heater.

9. A method according to claim 1, wherein the amount of non-adhesive polyolefine resin powder dispersed is between 50 grams per square meter and 100 grams per square meter.

10. A method according to claim 1, wherein the grain size of the non-adhesive polyolefine resin powder is between 70 mesh and 200 mesh.

11. A method according to claim 1, wherein the second layer is between 50 microns and 100 microns thick.

12. A method according to claim 1, wherein the resin layers on the plywood are flattened by press rollers having a temperature in the range of 90 to 100 degrees centigrade.

13. A method according to claim 2, wherein the non-adhesive polyolefine resin powder contains 0.5 to 5 percent fluorine resin.

14. A method according to claim 2, wherein the fluorine resin is ethylene tetrafluoride.

15. A method according to claim 1, wherein the cooling is performed with the use of water, thereby enabling the resin layers on the plywood to cool down rapidly.

* * * * *